US006250531B1

(12) United States Patent
Yagi

(10) Patent No.: US 6,250,531 B1
(45) Date of Patent: Jun. 26, 2001

(54) STAPLE LEG CUTTING MECHANISM FOR AN ELECTRIC STAPLER

(75) Inventor: Nobuaki Yagi, Tokyo (JP)

(73) Assignee: Max Co., Ltd., Tokyo (JP)

( * ) Notice: Subject to any disclaimer, the term of this patent is extended or adjusted under 35 U.S.C. 154(b) by 0 days.

(21) Appl. No.: 09/420,800

(22) Filed: Oct. 19, 1999

(30) Foreign Application Priority Data

Oct. 19, 1998 (JP) ..... 10-297005

(51) Int. Cl.[7] ..... B25L 5/02; B27F 7/23
(52) U.S. Cl. ..... 227/79; 227/155
(58) Field of Search ..... 227/79, 80, 131, 227/155

(56) References Cited

U.S. PATENT DOCUMENTS 4,378,085 * 3/1983 McVeigh ..... 227/79
4,644,634 * 2/1987 Jackson ..... 227/79
4,811,884 * 3/1989 Sato ..... 227/155
4,844,319 * 7/1989 Kurosawa ..... 227/79
6,036,074 * 3/2000 Manabe ..... 227/155
6,059,504 * 5/2000 Ishida et al. ..... 227/155

* cited by examiner

*Primary Examiner*—Scott A. Smith
(74) *Attorney, Agent, or Firm*—Morgan, Lewis & Bockius LLP

(57) ABSTRACT

An electric stapler for binding a material with a staple comprising a driver, a cutter, and a clincher. The driver engages the staple and drives leg portions of the staple through the material to be bound. The cutter cuts the leg portions of the staple in a predetermined length and forms a cut surface in each of the leg portions. The cut surface forms an obtuse angle where the cut surface and an outer surface of the leg portions meet each other. The clincher bends the leg portions of the staple after the leg portions piercing the material to be bound are cut.

6 Claims, 7 Drawing Sheets

STAPLE LEG CUTTING MECHANISM FOR AN ELECTRIC STAPLER

BACKGROUND OF THE INVENTION

1. Field of the Invention

The present invention relates to an electric stapler. More specifically, the present invention relates to a cutting mechanism for an electric stapler in which unnecessary portions of the leg portions of a staple, which pass through and are projected from an object to be stapled, are cut after the leg portions are bent inward.

2. Description of the Related Art

To staple a large number of sheets (for example, 100 sheets), a staple of which the crown portion is wide and the leg portions are long is generally used. When a small number of sheets are stapled with the same type of staple and the leg portions of the staple are bent, the leg portions are overlapped each other. In order to prevent the leg portions from being overlapped, a mechanism is known in which leg portions of a stapler are clinched after necessary portions of the leg portions for stapling, which pass through and are projected from the reverse side of a stapled object, are left and the rest of the leg portions are cut away. The above cutting mechanism, as shown in FIGS. 12A and 12B, includes a couple of support plates 30 for rotatably supporting movable clinchers (not shown). A cutter 31 is disposed at an intermediate portion of the couple of support plate 30 in a state that it is movable in the direction at a right angle with the support plates. The cutter 31 includes an opening 33 allowing the leg portions 32 of a staple to pass therethrough. The leg portions 32 of the staple, after they pass through a stapled object 34, are inserted into the space between the support plates 30, and pass through the opening 33. In this state, the cutter 31 is moved to cut away unnecessary portions of the leg portions 32 of the staple, as shown in FIG. 12C.

However, in the conventional cutting mechanism, when the leg portions of the staple are cut as described above, the corners 35 of the leg portions are formed at a substantially right angle. Therefore, as shown in FIG. 12D, when the stapling work ends and a stapled booklet is, for example, laid on top of another, there is a danger that the corners 35 of the leg portions of one booklet scratch the surface of the paper of another laid booklet 34*a*.

Accordingly, an object of the present invention is to provide a cutting mechanism for leg portions of staples in use with an electric stapler which is free from the above problem that the leg portions of a staple scratch or break the surface of another stapled object.

SUMMARY OF THE INVENTION

In order to attain the above object, the present invention provides an electric stapler for binding a material with a staple comprising a driver, a cutter, and a clincher. The driver engages the staple and drives leg portions of the staple through the material to be bound. The cutter cuts the leg portions of the staple in a predetermined length and forms a cut surface in each of the leg portions. The cut surface forms an obtuse angle where the cut surface and an outer surface of the leg portions meet each other. The clincher bends the leg portions of the staple after the leg portions piercing the material to be bound are cut.

Further, it is preferable that curved plates are disposed under the cutter, and the leg portions of the staple are bent inward by the curved plates, and then the leg portions are cut.

Moreover, it is more preferable that the leg portions of the staple are cut with a U-shaped or V-shaped cutter.

DETAILED DESCRIPTION OF THE PREFERRED EMBODIMENT

Hereinafter, preferred embodiments of a vehicle headlight will be described in detail with reference to the attached drawings. However, the preferred embodiments are merely an example of the present invention, and thus, the specific features described below are merely used to more easily describe such embodiments and to provide an overall understanding of the present invention. Accordingly, one skilled in the art will readily recognize that the present invention is not limited to the specific embodiment described below. Furthermore, the description of various configurations of the present invention which would have been known to one skilled in the art are omitted for the sake of clarity and brevity.

Figure 1:
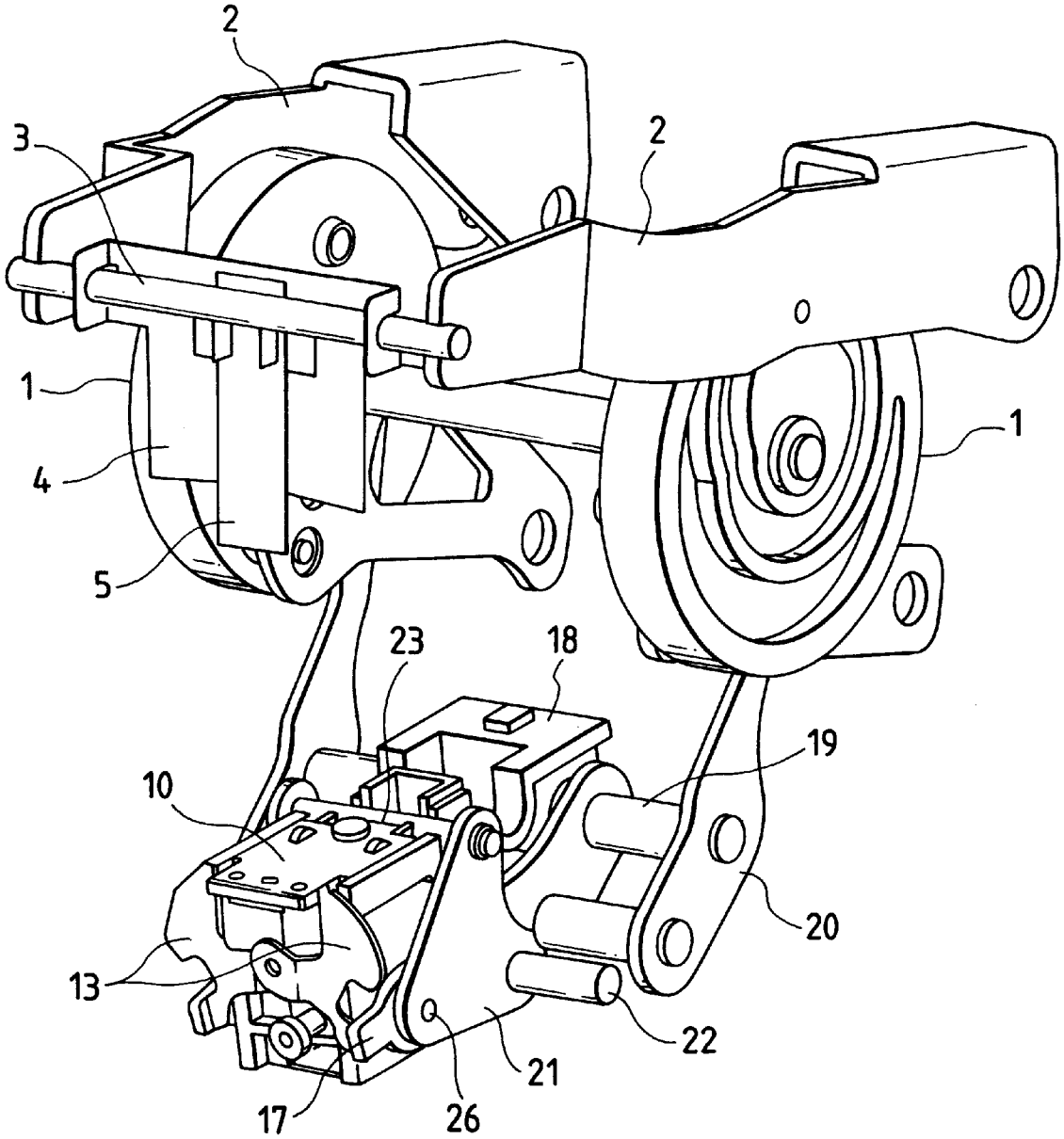
FIG. 1 is a perspective view showing a main portion of an electric stapler.

FIG. 1 is a perspective view showing a main portion of an electric stapler. As shown, the electric stapler includes a driving mechanism for a driver, a cutting mechanism, and a clincher mechanism. Both the cutting mechanism for a driver and the clincher mechanism are disposed under the driver mechanism.

The driver mechanism for a driver includes grooved cams 1 driven by an electric motor (not shown), drive links 2 which are swung as the grooved cams 1 are turned, a driver holder 4 supported by a coupling bar 3, which couples both leading ends of the drive links 2, and a driver 5 supported by the driver holder 4. In the thus constructed driver mechanism, when the grooved cams 1 are turned by the electric motor, the drive links 2 is swung and the driver 5 is vertically moved.

A staple supplying device (not shown) for supplying staples is provided under the driver 5. A stapling table 7 on which a stapled object 15 is located is provided under the driver 5. A couple of clincher holders 8, while being spaced from each other, are located under the stapling table 7. The clincher holders 8 guide the leg portions 6*a* of a staple 6 which is driven out by the driver 5, while the clincher holders 8 holds a movable clincher to be described later. A cutting mechanism for staple legs is penetrating the clincher holders 8 and a clincher mechanism are disposed in the clincher holders 8.

Figure 2:
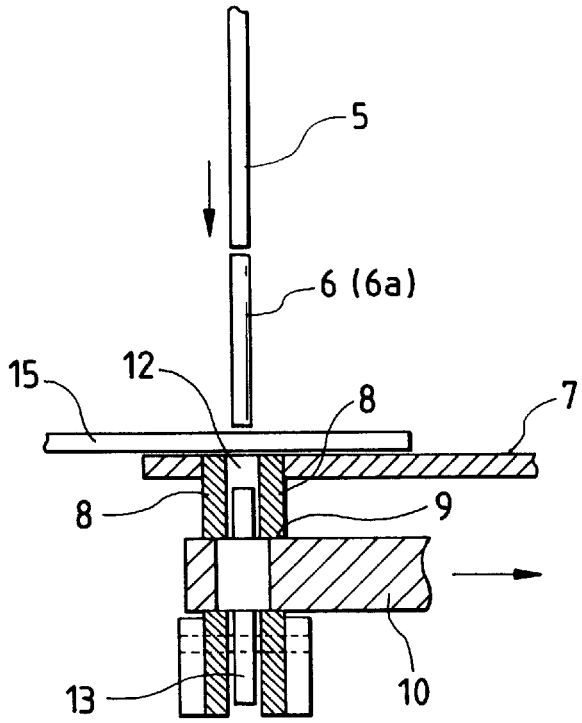
FIG. 2 is a sectional view showing a stapling portion of the electric stapler.
Figure 3:
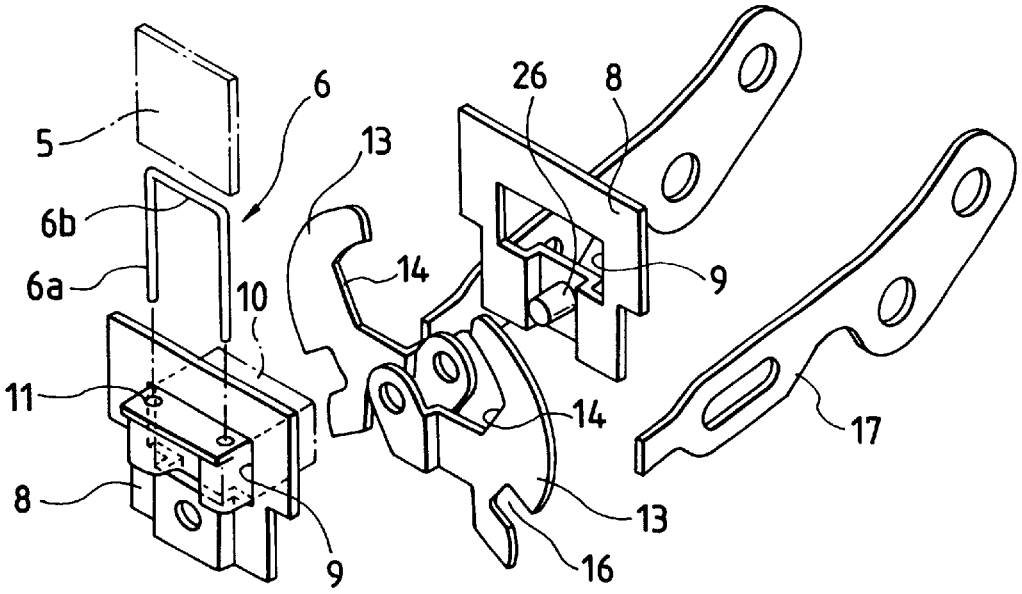
FIG. 3 is an exploded perspective view showing a cutting mechanism for staple legs and a clincher mechanism in the electric stapler according to the present invention.

As shown in FIGS. 2 and 3, the cutting mechanism for staple legs includes a rectangular hole 9 laterally elongated in the clincher holder 8. In the rectangular hole 9, a block-shaped cutter 10 is mounted and movable into and out of the rectangular hole 9. Leg receiving holes 11 are formed in the front portion of the cutter 10 so as to receive leg portions 6*a* of the staple 6. The leg receiving holes 11 are formed in a vertical direction and with elongated laterally.

Figure 4:
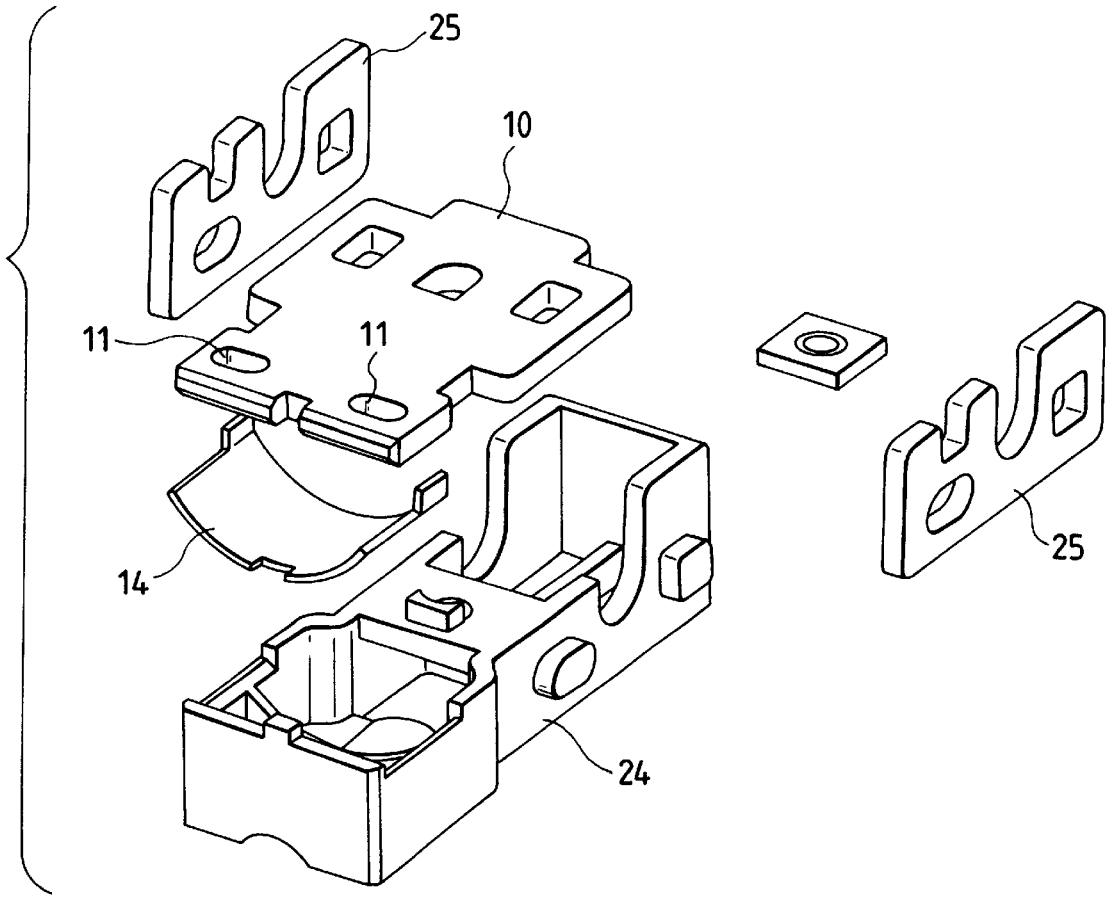
FIG. 4 is an exploded perspective view showing a main portion of the cutting mechanism for staple legs.
Figure 5:
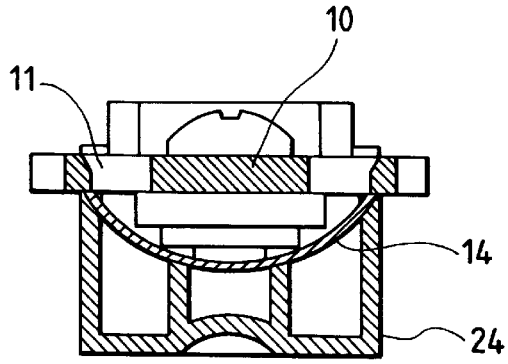
FIG. 5 is a traverse sectional view showing the cutting mechanism for staple legs.

As shown in FIGS. 4 and 5, curved plates 14 are disposed under the cutter.

Figure 6A:
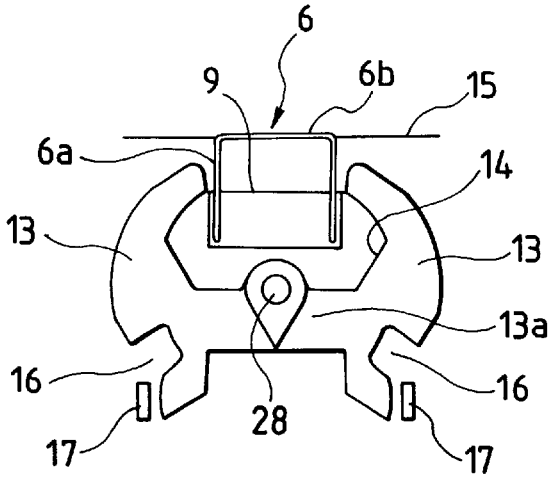
FIGS. 6A and 6B are diagrams explaining the operation of the clincher mechanism.

As shown in FIGS. 2 and 3, the stapling table 7 includes an opening 12 defined by a couple of the clincher holders 8. The opening 12 is positioned where a staple 6 reaches when the driver 5 is downwardly driven and hits the staple 6. The leg portions 6*a* of the staple 6 pass a space defined between a couple of the clincher holders 8. As shown in FIGS. 2, 3 and 6A, a couple of movable clinchers 13 are rotatably arranged between the clincher holders 8. Each of movable clinchers 13 is arcuately curved so as to avoid the rectangular hole 9 of the clincher holders 8. The bases 13*a* of the movable clinchers 13 are overlapped each other and rotatably supported by a shaft 26. When the movable clinchers 13 are turned, each leading end 13*b* is moved along the underside of the stapled object 15, and the movable clinchers 13 are opened and closed. Each of the movable clinchers 13 includes an engaging groove 16 which is formed in the outer edge at a lower position thereof.

As shown in FIGS. 1, 3 and 6A, clincher levers 17 are respectively arranged under the movable clinchers 13, and are vertically movable. The clincher levers 17 are arranged in such a manner that the leading ends of the clincher levers 17 are engageable with engaging grooves 16 of the movable clincher 13. The clincher levers 17 are swingably supported at their central portion by a support shaft 19. The support shaft 19 is provided on a base table 18 integral with the stapling table 7 of the electric stapler. A drive link 20 is coupled with the rear portion of each of the clincher levers 17. Each rear end of the drive links 20 is engaged with a groove (not shown) formed on the rear side of the grooved cam 1. A triangular link plate 21 is located near each of clincher levers 17 and supported by a shaft 22 in a swingable fashion. The front end of the triangular link plate 21 is coupled with the corresponding clincher lever 17 by a shaft 26, and the upper end part thereof is coupled with the cutter 10 by a shaft 23. With the above arrangement, when the grooved cams 1 are turned, the drive links 20 is swung, and then the movable clinchers 13 and the cutter 10 is operated.

In the electric stapler thus constructed, when the grooved cams 1 are turned by the electric motor, the drive links 2 is swung and then the driver 5 is vertically moved. When the driver 5 is downwardly driven, it hits the staple 6, and the leg portions 6*a* of the staple 6 pierce through the stapled object 15. The leg portions 6*a* of the staple 6, which have passed through the stapled object 15, are respectively inserted into the leg receiving holes 11 of the cutter 10, which is projected and located in front of the clincher holders. At this time, tips of the leg portions 6*a* abut against the curved plates 14 located thereunder, and the leg portions 6*a* are bent inward.

Figure 8:
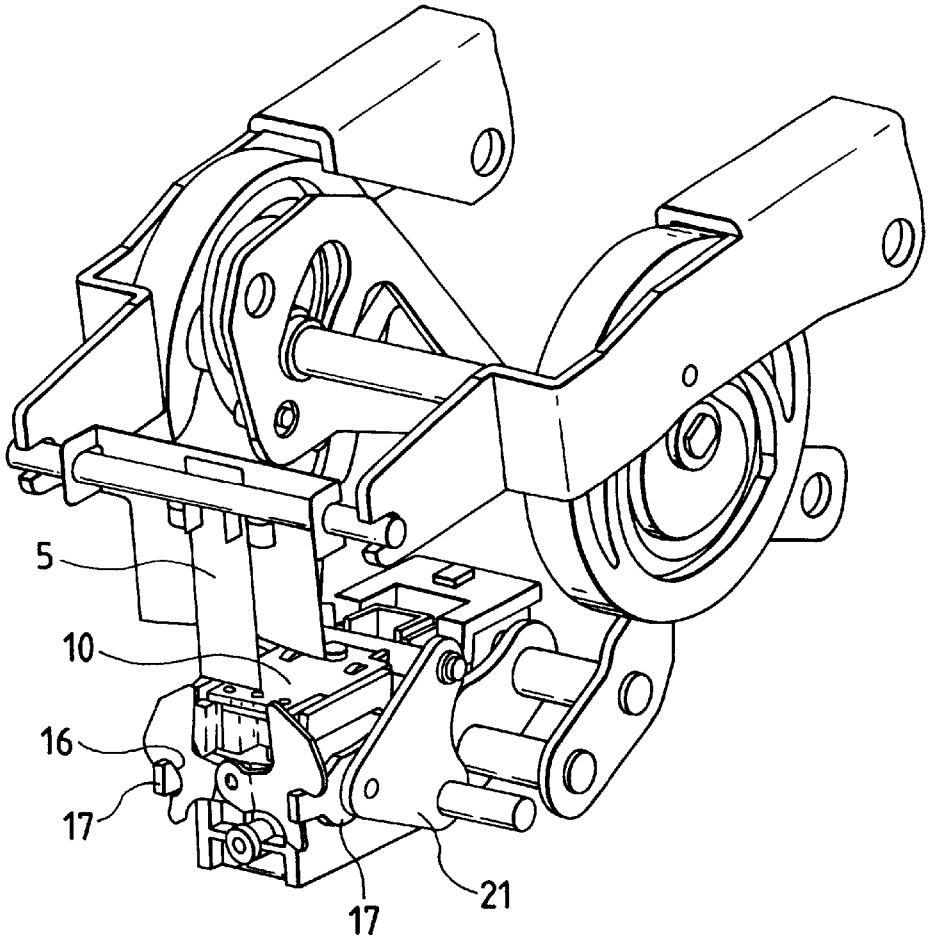
FIG. 8 is a perspective view showing a main potion of the electric stapler when the cutting mechanism for staple legs is operated.
Figure 9A:
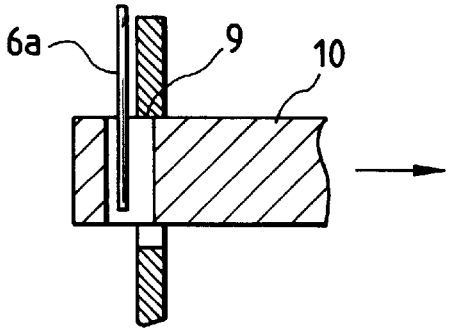
FIGS. 9A and 9B are diagrams explaining an operation of the cutting mechanism for staple legs.
Figure 9B:
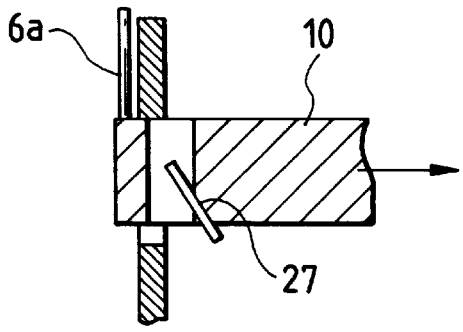

Thereafter, the drive link 20 is similarly turned by the grooved cams 1 to move the clincher levers 17 upwardly. Thus, as shown in FIG. 8, the link plates 21 are turned to retract the cutter 10, which has been located in front of the clincher holders. Then, the cutter 10 cuts the unnecessary portions 25 of the leg portions 6*a,* as shown in FIGS. 9(*a*) and 9(*b*).

Figure 6B:
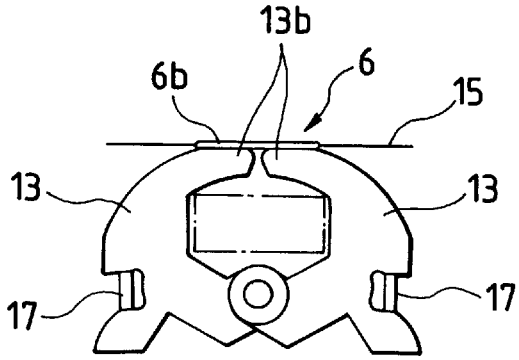
Figure 7:
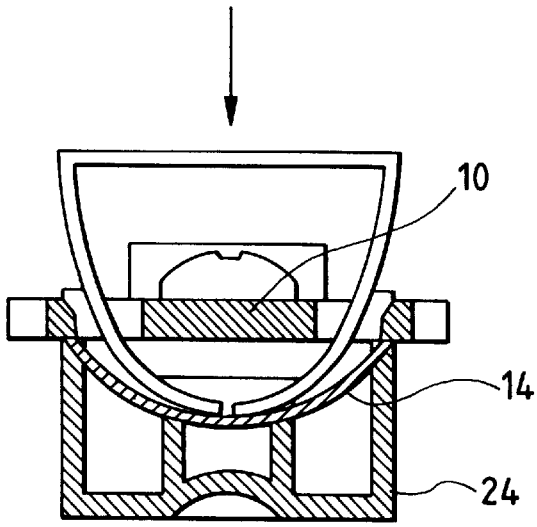
FIG. 7 is a cross sectional view showing a state that the leg portions of a staple are put in the cutting mechanism for staple legs.

Immediately after cutting the leg portions of the staplers, the front ends of the clincher levers 17 engage with the engaging grooves 16 of the movable clinchers 13 to push the movable clinchers 13 upwardly. As a result, the movable clinchers 13 turn in the closing direction about the shaft 26, to thereby bend the leg portions 6*a* of the staple 6 inward, as shown in FIGS. 6A and 6B. Then the stapling operation of the electric stapler ends.

Figure 10A:
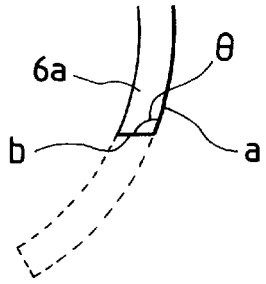
FIG. 10A is a diagram showing the cutting of the leg portions of a staple.
Figure 10B:
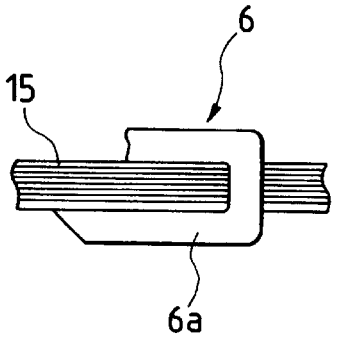
FIG. 10B is a diagram showing the bending of the leg portions after cutting.

As described above, after the leg portions 6*a* of staple pass through the stapled object 15, the unnecessary portions 25 of the leg portions 6*a* abut against the curved plates 14 to be curled inward. Then, after the leg portions 6*a* are curled inward, the unnecessary portions 25 are cut away by the cutter 10. Therefore, an angle of an outer surface "a" of each leg portion 6*a* with respect to a cut surface "b" is obtuse as in FIG. 10A. Where the angle is obtuse, the cut surface is hard to be burred, and hence burr is little formed at the outside of the cut portion of each leg portion. Even if burr is formed, it is negligible in size. For this reason, when the movable clinchers 13 bend the leg portions 6*a* of the staple, no or a little burr is exposed outside as shown in FIG. 10B. Therefore, when the stapling work ends and the stapled booklets are overlapped on top of another, there is no danger that the corners of the leg portions of one booklet scratch the surface of the paper of another booklet.

Figure 11A:
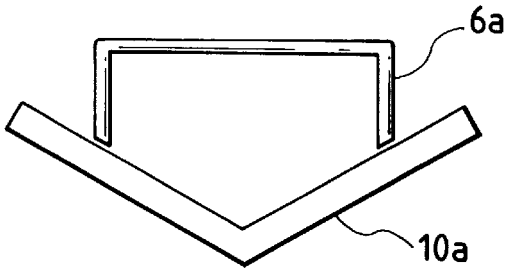
FIGS. 11A and 11B are diagrams showing explaining an operation with other types of the cutter.
Figure 11B:
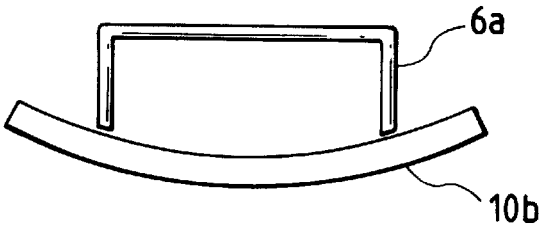
Figure 12A:
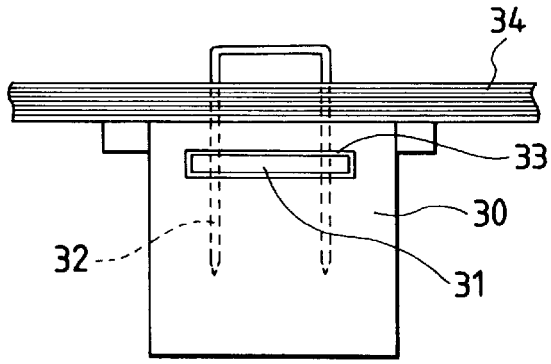
FIG. 12A is a cross sectional view of a conventional cutting mechanism when the cutting mechanism is viewed from the front.
Figure 12B:
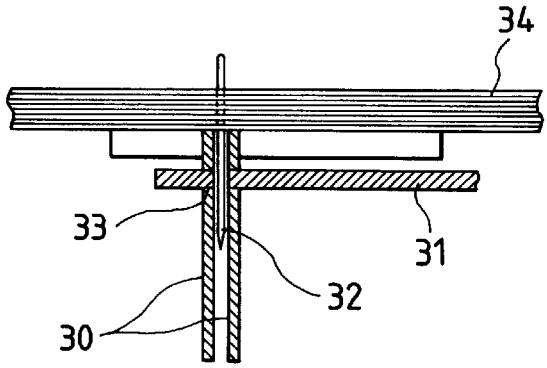
FIG. 12B is a cross sectional view of the conventional cutting mechanism as shown in FIG. 12A when it is viewed from the side.
Figure 12C:
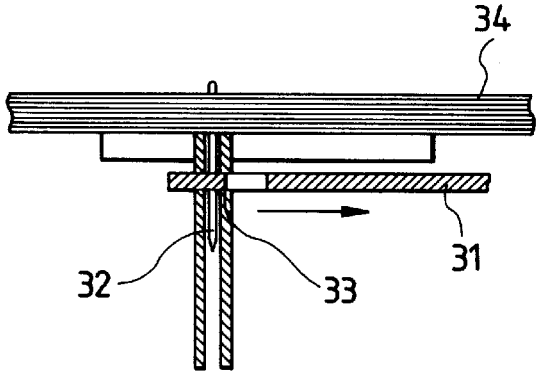
FIG. 12C is a diagram explaining an operation of the conventional cutting mechanism as shown in FIG. 12A.
Figure 12D:
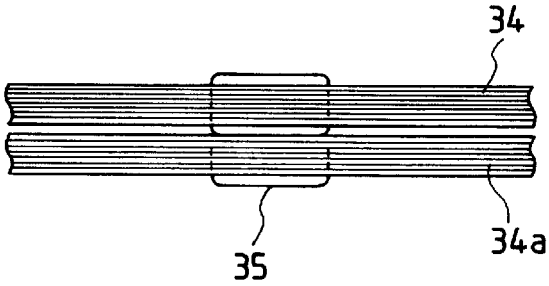
FIG. 12D is a diagram showing a stapled state according to the conventional cutting mechanism as shown in FIG. 12A.

It is evident that the shape of the cutter for cutting the leg portions 6*a* is not limited to the planar shape as mentioned above. It may be V shaped as shown in FIG. 11A or U shaped as shown in FIG. 11B.

While only certain embodiments of the present invention have been specifically described herein, it will be apparent that numerous modifications may be made thereto without departing from the spirit and scope of the invention.

The present invention is based on Japanese Patent Application No. Hei. 10-297005 which is incorporated herein by reference.

What is claimed is:

1. An electric stapler for binding a material with a staple comprising:

a driver for engaging the staple and driving leg portions of the staple through the material to be bound;

a cutter for cutting the leg portions of the staple in a predetermined length, said cutter forming a cut surface in each of the leg portions, said cut surface forming an obtuse angle where said cut surface and an outer surface of the leg portions meet each other; and a clincher for bending the leg portions of the staple after the leg portions piercing the material to be bound are cut.

2. The electric stapler according to claim 1, further comprising at least one curved plate which curves the leg portions of the staple inwardly before the leg portions are cut.

3. The electric stapler according to claim 2, wherein said cutter is U-shaped.

4. The electric stapler according to claim 2, wherein said cutter is V-shaped.

5. The electric stapler according to claim 1, wherein said cutter is U-shaped.

6. The electric stapler according to claim 1, wherein said cutter is V-shaped.

* * * * *